US005507840A

United States Patent [19]

Schrell et al.

[11] Patent Number: 5,507,840

[45] Date of Patent: Apr. 16, 1996

[54] PROCESS FOR THE PREPARATION OF MODIFIED FIBER MATERIAL AND PROCESS FOR THE DYEING OF THE MODIFIED FIBER MATERIAL WITH ANIONIC TEXTILE DYES

[75] Inventors: Andreas Schrell, Coesfeld; Werner H. Russ, Flörsheim am Main; Thomas Riehm, Hattersheim am Main, all of Germany

[73] Assignee: Hoechst Aktiengesellschaft, Frankfurt, Germany

[21] Appl. No.: 400,184

[22] Filed: Mar. 6, 1995

Related U.S. Application Data

[63] Continuation of Ser. No. 984,977, Dec. 3, 1992, abandoned.

[30] Foreign Application Priority Data

Dec. 7, 1991 [DE] Germany ..... 41 40 410.6
Jul. 23, 1992 [DE] Germany ..... 42 24 283.5

[51] Int. Cl.[6] ..... D06P 1/39; D06P 1/38; D06P 5/22; D06P 3/66

[52] U.S. Cl. ..... 8/532; 8/543; 8/565; 8/568; 8/573; 8/574; 8/584; 8/588; 8/591; 8/604; 8/606; 8/611

[58] Field of Search ..... 8/565, 568, 573, 8/574, 582, 584, 588, 591, 604, 606, 611, 549, 115.57, 115.58, 181, 188, 189, 543, 532, 918

[56] References Cited

U.S. PATENT DOCUMENTS

| | | | |
|---|---|---|---|
| 1,622,122 | 3/1927 | Rabe . | |
| 2,168,253 | 8/1939 | Balle | 8/181 |
| 4,069,159 | 1/1978 | Hayek | 252/8.8 |
| 4,453,945 | 6/1984 | Miyamoto et al. | 8/543 |
| 4,721,512 | 1/1988 | Topsl et al. | 8/188 |
| 4,988,365 | 1/1991 | Sternberger et al. | 8/543 |

FOREIGN PATENT DOCUMENTS

| | | |
|---|---|---|
| 635252 | of 1962 | Belgium . |
| 638513 | of 1963 | Belgium . |
| 580544 | 11/1924 | France . |
| 479341 | 2/1938 | United Kingdom . |

OTHER PUBLICATIONS

Guthrie, J. D., *Textile Research J.* 17:625–629 (1947).
Reeves, W. A., et al., *Textile Research J.* 23:522–527 (1953).
Rath, H., *Melliand Textilberichte* 45:641–647 (1964).
Roberts, E. J., et al, *Textile Research J.* 39:686–691 (1969).

*Primary Examiner*—Margaret Einsmann
*Attorney, Agent, or Firm*—Connolly and Hutz

[57] ABSTRACT

A process for the dyeing of fiber materials with water-soluble anionic dyes, in particular those having a fiber-reactive group, is described, according to which dyeing is carried out using low-electrolyte or entirely electrolyte-free and/or low-alkali or entirely alkali-free dye solutions (dye liquors, printing pastes) and in which a fiber material is used which was modified by means of a saturated straight-chain or branched aliphatic or cycloaliphatic compound which is unsubstituted or substituted by one or more hydroxy groups and contains at least one primary, secondary or tertiary amino group or quaternary ammonium group and at least one hydrolyzable ester group, it also being possible for the aliphatic radical in this compound to be interrupted by one or more hetero groups. Modifikation of the fiber material is carried out such that the aliphatic compound mentioned which contains amino and ester groups is applied to the fiber material in aqueous solution and the impregnated material is subjected to a heat treatment. Furthermore, a few new aliphatic compounds containing amino and ester groups are described which can be used for the modification of the fiber material.

10 Claims, No Drawings

PROCESS FOR THE PREPARATION OF MODIFIED FIBER MATERIAL AND PROCESS FOR THE DYEING OF THE MODIFIED FIBER MATERIAL WITH ANIONIC TEXTILE DYES

CROSS REFERENCE TO RELATED APPLICATIONS

This application is a continuation of application Ser. No. 07/984,977, filed Dec. 3, 1992, now abandoned.

BRIEF SUMMARY OF THE INVENTION

Today's state of the art absolutely requires the use of electrolyte salts and urea and alkalis in the dyeing and printing processes for the dyeing of textile materials with anionic dyes, in order to ensure satisfactory migration and adsorption of the dye on the fiber and its fixation thereon. The large amounts of such auxiliary chemicals released after completion of the dyeing process are often no longer justifiable for ecological reasons. Accordingly, the object of the present invention was to find a process for the dyeing (including printing) of textile fiber materials which can be carried out using only minimal amounts of electrolyte salts, such as sodium chloride and sodium sulfate, or entirely in the absence of electrolyte salts and, at the same time, using only small amounts of an alkaline agent, such as sodium carbonate, sodium hydroxide or sodium silicate, or entirely in the absence of such an alkaline agent. The use of alkaline agents is in particular necessary for fixing the industrially important reactive dyes on the fiber. A dyeing process which can be carried out using a small amount of salt or entirely in the absence of salt and, at the same time, using only small amounts of an alkaline agent or entirely in the absence of such an alkaline auxiliary is therefore advantageous in particular in dyeing processes in which fiber-reactive dyes are used. The reason for this is that apart from the process of fixing the fiber-reactive dye, hydrolysis reactions on the fiber-reactive dye can additionally take place in the aqueous, often strongly alkaline dye liquor, resulting in incomplete fixation on the fiber material. For this reason, the dyeing process must be followed by washing and rinsing processes which in some cases are extensive and time-consuming, such as multiple rinsing with cold and hot water and a neutralization treatment in-between in order to remove excess alkali on the dyed material, and furthermore, for example, a wash at the boil with a nonionic detergent in order to ensure the good fastness properties of the dyeing.

It is true that modification of the cellulose with aminoethylsulfuric acid via the ethyleneimine and subsequent dyeing with direct dyes is already known (see Text. Res. J. 17, 625 (1947); loc. cit. 23, 522 (1953) and 39, 686 (1969)). Further studies subsequently showed (see Melliand Textilber. 45, 641 (1964)) that fibers modified in this manner can also be dyed with monochlorotriazine dyes. However, the alkaline active compound solutions used in these known processes for the treatment of cotton were in all cases 25% in sodium hydroxide, and the liquor pickup on the impregnated fabric was more than 100% by weight. After extended pre-dyeing, fixation was carried out at temperatures above 100° C. for several minutes. This procedure for the modification of cotton is extremely uneconomical; moreover, it is not possible to dye the treated fabric level and produce a uniform appearance.

DETAILED DESCRIPTION OF THE INVENTION

According to the present invention, it has now been found that the use of anionic textile dyes, in particular of those having fiber-reactive groups, without or with only slight amounts of alkaline agents and electrolyte salts surprisingly produces level dyeings of high color strength and good wear fastness properties if the textile material used is a fiber material which has been pretreated and modified by a compound which is a saturated aliphatic compound of 3 to 15 carbon atoms, preferably of 3 to 12 carbon atoms, which is unsubstituted or substituted by 1 or 2 or more, such as 3 to 5, hydroxy groups and contains at least one primary, secondary or tertiary amino group or quaternary ammonium group and at least one hydrolyzable ester group, the aliphatic radical(s) being straight-chain, branched and/or cyclic and, if desired, interrupted by one or more, such as two or three, hetero groups, such as amino groups and oxygen atoms, and it also being possible for the amino group(s) to be part of a saturated heterocyclic radical, compounds of the formula (A) mentioned and defined below being however excepted.

The compounds used according to the invention and containing amino and ester groups, in particular sulfuric ester groups, are, by virtue of their constitution, incapable of forming an intermediate having an ethyleneimine structure; they are capable of reacting with the cellulose fiber by nucleophilic substitution. Compared with the abovementioned known processes of modification of cotton, the amount of alkali used can be reduced by 75%; similarly, the fixing times can be considerably shortened. Since in the process according to the invention application can take place analogously to customary dyeing processes, the process according to the invention can be integrated into a continuous process for the general pretreatment of fiber materials especially in those cases where the alkali necessary for fixing is already present anyway. Furthermore, the process according to the invention for the dyeing of fiber materials modified according to the invention, in particular by the exhaust method, makes the single dyeing of polyester/cotton blend fabrics with reactive and disperse dyes possible without any possibility of damaging the disperse dye, precisely because alkali is not present in this single-bath dyeing process.

The compounds usable according to the invention for the modification of fiber materials contain, as ester groups, at least one hydrolyzable ester group, such as esters of sulfuric acid, phosphoric acid, lower alkanecarboxylic acids (here and hereinafter the term "lower" meaning that the groups contain or are alkyl radicals of 1 to 4 carbon atoms), as of acetic acid, benzenesulfonic acid and derivatives thereof substituted on the benzene ring by substituents from the group comprising sulfo, carboxy, lower alkyl, lower alkoxy and nitro, such as of p-toluenesulfonic acid and mesitylenesulfonic acid (the acidic esters of sulfuric acid and phosphoric acid are also designated as sulfato and phosphato groups; they have the formula —$OSO_3M$ and —$OPO_3M_2$, in which M is a hydrogen atom or an alkali metal, such as sodium, potassium or lithium).

The fiber-modifying compounds preferably contain only one ester group. If the fiber-modifying compounds do not contain an azacyclic radical, they preferably contain at least one hydroxy group.

The compounds not usable according to the invention have the formula (A)

$$(H_2N)_p\text{- ALK-ER} \qquad \text{(A)}$$

in which p is the number 1 or 2, ER is an ester group and ALK is a straight-chain or branched alkylene radical of 2 to 6 carbon atoms which may be interrupted by 1 or more hetero groups and is not substituted by a hydroxy group.

Accordingly, the present invention relates to a process for the dyeing of fiber materials with water-soluble, anionic dyes, preferably with fiber-reactive dyes, which comprises carrying out the dyeing using low-electrolyte or entirely electrolyte-free and/or low-alkali or entirely alkali-free dye solutions (dye liquors, printing pastes) and using a fiber material pretreated and modified by the compounds containing ester and amino groups and defined above in more detail.

Examples of aliphatic compounds containing amino and ester groups and usable according to the invention are compounds having the formulae (1a) and (1b)

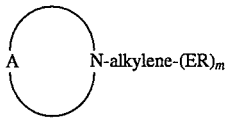

(1a)

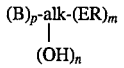

(1b)

in which the symbols have the following meanings:

ER is an ester group;

A and N, together with 1 or 2 alkylene groups of 1 to 4 carbon atoms,, form the bivalent radical of a heterocyclic ring, preferably of a 5- or 6-membered heterocyclic ring, such as, for example, of a piperazine, piperidine or morpholine ring, in which A is an oxygen atom or a group of the formula (a), (b) or (c)

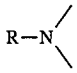

(a)

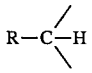

(b)

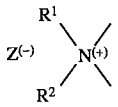

(c)

in which

R is a hydrogen atom or an amino group or an alkyl group of 1 to 6 carbon atoms, preferably of 1 to 4 carbon atoms, which may be substituted by 1 or 2 substituents from the group comprising amino, sulfo, hydroxy, sulfato, phosphato and carboxy, or is an alkyl group of 3 to 8 carbon atoms, preferably of 3 to 5 carbon atoms, which is interrupted by 1 or 2 hetero groups selected from the groups comprising —O— and —NH— and can be substituted by an amino, sulfo, hydroxy, sulfato or carboxy group, $R^1$ is hydrogen, methyl or ethyl, $R^2$ is hydrogen, methyl or ethyl, and $Z^{(-)}$ is an anion, such as, for example, a chloride, hydrogen sulfate or sulfate anion;

B is an amino group of the formula $H_2N$— or an amino or ammonium group of the formula (d) or (e)

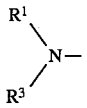

(d)

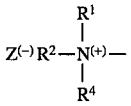

(e)

in which $R^1$, $R^2$ and $Z^{(-)}$ have one of the abovementioned meanings, $R^3$ is methyl or ethyl, and $R^4$ is hydrogen, methyl or ethyl;

p is the number 1 or 2, preferably 1;

alkylene is a straight-chain or branched alkylene radical of 2 to 6 carbon atoms, preferably of 2 to 4 carbon atoms, which can be substituted by 1 or 2 hydroxy groups, or is a straight-chain or branched, preferably straight-chain, alkylene radical of 3 to 8 carbon atoms, preferably of 3 to 5 carbon atoms, which is interrupted by 1 or 2 hetero groups selected from the groups comprising —O— and —NH—;

alk is a straight-chain or branched alkylene radical of 2 to 6 carbon atoms, preferably of 2 to 4 carbon atoms, or is a straight-chain or branched, preferably straight-chain, alkylene radical of 3 to 8 carbon atoms, preferably of 3 to 5 carbon atoms, which is interrupted by 1 or 2 hetero groups selected from the groups comprising —O— and —NH—, and is preferably a straight-chain or branched alkylene radical of 2 to 6 carbon atoms, preferably of 2 to 4 carbon atoms;

m is the number 1 or 2, preferably 1;

n is a number from 1 to 4, preferably 1 or 2;

and the amino, hydroxy and ester groups can be bound to a primary, secondary or tertiary carbon atom on the alkylene radical.

Examples of such compounds containing ester and amino groups and usable according to the invention are N-(β-sulfatoethyl)piperazine, N-[β-(β'-sulfatoethoxy)ethyl] piperazine, N-(γ-sulfato-β-hydroxypropyl)piperidine, N-(γ-sulfato-β-hydroxypropyl)pyrrolidine, N-(β-sulfatoethyl)piperidine, 3-sulfato 2-hydroxypropyltrimethylammonium salts, such as 3-sulfato-2-hydroxypropyltrimethylammonium sulfate, 2-sulfato-3-hydroxy- 1-aminopropane, 3-sulfato-2-hydroxy-1-aminopropane, 1-sulfato-3-hydroxy-2-aminopropane, 3-hydroxy-1-sulfato- 2-aminopropane, 2,3-disulfato-1-aminopropane and 1,3-disulfato-2-aminopropane and derivatives of these compounds with an ester group other than a sulfato group, such as a phosphato group, an alkanoyloxy group of 2 to 5 carbon atoms, such as an acetyloxy group, or a phenylsulfonyloxy group which is unsubstituted or substituted by substituents from the group comprising sulfo, carboxy, alkyl of 1 to 4 carbon atoms, alkoxy of 1 to 4 carbon atoms and nitro, such as a p-tosyloxy and 3,4,5-trimethylphenylsulfonyloxy group.

The compounds usable according to the invention can be prepared by starting from the corresponding hydroxy-containing compounds and esterifying the hydroxy groups in the usual manner by reaction with the acids or the corresponding acylating agents, it being preferred, if the amino-containing starting compounds have more than one hydroxy group, to esterify only one of these hydroxyl groups. Such procedures are disclosed in the literature; the preparation of the compounds usable according to the invention can be carried out analogously to such known procedures. Thus, for example, Houben-Weyl, Methoden der Organischen Chemie (Methods of Organic Chemistry), Volume VI/2, pages 452–457, and Volume E11, pages 997ff., describes the esterification of amino alcohols to give their sulfuric esters. Further usual modifications of such procedures consist, for example, in stirring the amino alcohol into a large excess of fuming sulfuric acid (see Chem. Ber. 51, 1160) or are based on the use of indifferent solvents which serve as reaction medium during esterification, it being possible to use equimolar amounts of concentrated sulfuric acid (see German Patent No. 825,841). Examples of esterifying and acylating agents which can serve as starting compounds for preparing the compounds containing ester and amino groups and usable according to the invention are sulfuric acid, phosphoric acid, polyphosphoric acid, alkanecarboxylic acids of 2 to 5 carbon atoms and the chlorides or anhydrides thereof, such as, for example, acetic acid (glacial acetic acid) and acetic anhydride, benzenesulfonic acid and benzenesulfonic acids substituted on the benzene ring by substituents from the group comprising sulfo, carboxy, alkyl of 1 to 4 carbon atoms, alkoxy of 1 to 4 carbon atoms and nitro or sulfonyl chlorides thereof. For example, the sulfato compounds can be prepared from the corresponding hydroxy compounds by adding the hydroxy compounds to the required amount, i.e., preferably equimolar amount, of concentrated sulfuric acid and stirring them therein at a temperature of between 5° and 30° C. for some time until they are completely dissolved. They are isolated from the sulfuric acid solution by pouring the solution onto ice and neutralization, by precipitation of the sulfate ions as calcium sulfate by means of calcium carbonate, followed by filtration and evaporation of the aqueous solution. For example, the sulfato compounds can be obtained in the form of crystalline or semicrystalline substances which can be used directly in the process for modifying the fiber material.

Fiber materials are understood to mean natural and synthetic fiber materials containing hydroxy and/or carboxamide groups, such as silk, wool and other animal hair and synthetic polyamide fiber mateirals and polyurethane fiber materials, for example nylon 4, nylon 6 and nylon 11, and in particular fiber materials containing the basic structure of α,β-glucose, such as cellulose fiber materials, for example cotton, hemp, jute and linen, and regenerated derivatives thereof, such as filament viscose and staple viscose, or mixtures of such fiber materials.

The terms "dyeing", "dyeing process" and "dyeings" include printing processes and prints.

"Anionic dyes" are understood to mean those dyes containing anionic, i.e., acidic groups, such as sulfo and carboxy groups, or salts thereof, such as alkali metal salts, and which are therefore water-soluble. In particular, they are understood to mean those anionic dyes having a fiber-reactive group, i.e. a group which is usually capable of reacting with the carboxamide or hydroxyl groups of the fiber material and forming a bond therewith.

The invention furthermore relates to a process for the modification of a fiber material, which comprises causing a fiber material to come under the action of a saturated aliphatic compound of 3 to 15 carbon atoms, preferably of 3 to 12 carbon atoms, which contains ester and amino groups and is unsubstituted or substituted by 1 or 2 or more, such as 3 to 5, hydroxy groups and contains at least one primary, secondary, tertiary or quaternary amino group and at least one hydrolyzable ester group in which the aliphatic radical(s) is(are) straight-chain, branched and/or cyclic and can, if desired, be interrupted by one or more, such as two or three, hetero groups, such as amino groups and oxygen atoms, and the amino group(s) can also be part of a saturated heterocyclic radical, compounds of the formula (A) being however excepted, in aqueous, alkaline solution at a temperature of between 60° and 230° C., preferably between 90° and 190° C.

Furthermore, the invention relates to the use of such compounds containing ester and amino groups and defined above in more detail for the modification of fiber materials, in particular with the aim of being able to use them for dyeing with water-soluble, anionic dyes without or with only small amounts of electrolyte salts and alkaline agents.

The process according to the invention for modification of the fiber material can, for example, be carried out such that the fiber material is brought into contact with the aliphatic compound containing amino and ester groups in alkaline aqueous solution. The concentration of this compound in the alkaline aqueous solution is usually between 1 and 20% by weight, preferably 5 and 10% by weight. The alkaline agent, such as, for example, sodium hydroxide, sodium carbonate or potassium carbonate, can be present in a concentration of between 1 and 20% by weight; the alkaline agent is preferably used in a concentration of between 1.5 and 10% by weight, the amount depending not only on the amount of the aliphatic compound containing amino and ester groups used but also on the material to be pretreated. Thus, in the case of polyester materials, high concentrations of alkali should be avoided. As a rule, the alkaline, aqueous solution containing the compound containing amino and ester groups has a pH of between 10 and 14.

The fiber material which is not only modified according to the invention but also used in modified form in the dyeing process according to the invention can be present in any processing state, for example as yarn, loose fibers, tops, piece goods (fabric), and also in a mixture with other fiber materials, such as, for example, in the form of cotton/polyester fiber materials and in the form of blend fabrics with other fiber materials.

Some of the compounds containing ester and amino groups and usable according to the invention have not yet been described and are thus novel. Accordingly, the present invention also relates to these new compounds. Examples of novel compounds usable according to the invention are N-(γ-sulfato-β-hydroxypropyl)piperidine, N-(β-sulfatoethyl)piperidine, N-(γ-sulfato-β-hydroxypropyl)piperidine, N-(γ-sulfato-β-hydroxypropyl)pyrrolidine, 3-sulfato-2-hydroxy-1-aminopropane, 2-sulfato-3-hydroxy- 1-aminopropane, 2-sulfato-3-hydroxy- and 3-sulfato- 2-hydroxypropyltrimethylammonium salts and derivatives thereof with an ester group other than the sulfato group.

The aliphatic compounds containing ester and amino groups and usable according to the invention can be brought into contact with the fiber material by the dyeing process according to the invention in various ways in alkaline aqueous solution, for example by treatment of the fiber material in an alkaline, aqueous solution of the compound containing ester and amino groups (analogously to dyeing by the exhaust method) at a temperature of between 15° and 100° C., which leads to modification of the fiber mateiral in particular at the higher temperatures, such as above 80° C. Other possibilities are to pad or nip-pad the fiber material with the aqueous, alkaline solution or to spray the fiber material with the solution. If impregnation of the fiber material with this alkaline, aqueous solution takes place by introducing the fiber material into this solution or by padding, the impregnated material is then squeezed off to remove excess liquor so that the pickup on this aqueous, alkaline solution is between 50 and 120% by weight, preferably between 70 and 100% by weight, relative to the fiber material. As a rule, impregnation (by padding, nip-padding or treatment in the solution itself) takes place at a temperature of between 10° and 60° C., preferably at a temperature of between 15° and 30° C. If the fiber material is sprayed with the solution, which usually takes place at a temperature of between 10° and 40° C., the liquid pickup selected is preferably between 10 and 50% by weight.

If the fiber material is a mercerized cellulose fiber material, the compound containing amino and ester groups and usable according to the invention can advantageously also be applied to the cellulose fiber material to be modified immediately after the mercerization process, in which the mercerized material still contains the alkali, by, for example, squeezing off, if desired, the material obtainable after the mercerization process and impregnated with the aqueous alkali to the required liquid content and impregnating the material impregnated with alkali with the aqueous solution of the compound containing amino and ester groups and usable according to the invention, it being possible for impregnation to be carried out by overpadding, by spraying and similar process steps customary and known in the art.

After impregnation of the fiber material by one of the abovementioned methods, with the exception of the exhaust method, the impregnated material is dried; fixing of the fiber-modifying, amino-containing compound is carried out simultaneously with drying, a temperature of between 100° and 230° C., preferably of between 130° and 190° C., being selected for drying and fixing. As a rule, drying and simultaneous fixing takes place by a hot-air treatment of 0.5 to 3 minutes. However, fixing of the fiber-modifying, amino-containing compound on the fiber material can also be effected by simply drying at elevated temperature; thus, for drying and fixing the modifying compound on the fiber material, it can be suspended in drying cabinets and exposed to the required elevated temperatures, such as, for example, 80° to 105° C.

Aftertreatment of the modified fiber material takes place by rinsing with cold and hot water and, if desired, by treatment in an aqueous bath containing a small amount of acid, such as acetic acid, in order to remove the alkali from the fiber material, followed by drying. If possible, a neutral fiber material should be used in the dyeing process.

The dyeing according to the invention of fiber materials modified in this manner is carried out analogously to known dyeing procedures and printing processes for the dyeing and printing of fiber materials with water-soluble textile dyes, such as anionic dyes, in particular fiber-reactive dyes, and using the temperature ranges known to be used for this purpose and the customary amounts of dye, but with the exception according to the invention that the dye baths, padding liquors and printing pastes of the dyeing processes according to the invention require little or no addition of alkaline compounds such as are customarily used for fixing fiber-reactive dyes, for example sodium carbonate, potassium carbonate, sodium hydroxide solution and sodium silicate, and, furthermore, electrolyte salts, which are customarily added in order in particular to increase migration of the dye on the fiber, are unnecessary or necessary only in a small amount, for example up to a maximum of 10 g per liter of dye bath or dye liquor. Accordingly, the dyeing process according to the invention takes place within a pH range of between 4 and 8, preferably of between 4.5 and 7.

Examples of dyeing processes which can be used according to the invention are the various exhaust methods, such as dyeing in a jigger and in a reel beck or dyeing from a long or short liquor, dyeing in jet-dyeing machines, dyeing by the cold pad-batch method or by a pad hot-steam fixation method. In the exhaust method, dyeing can be carried out at a customary liquor ratio of 3:1 to 20:1. The dyeing temperature can be between 30° and 90° C., and is preferably at a temperature below 60° C.; as can be seen from the abovementioned use according to the invention of the cold pad-batch method, dyeing is advantageously also possible at room temperature (10° to 30° C.).

In the dyeing process according to the invention, it is possible to dispense entirely, or to a significant extent, with the customary, often necessary, dyeing assistants, such as surfactants (wetting agents), thiourea, thiodiethylene glycol, thickeners, levelling agents, auxiliaries improving the solubility of dyes in the concentrated padding liquors, such as, for example, condensation products of formaldehyde with unsubstituted or alkyl-substituted naphthalenesulfonic acids, and in particular urea. As a rule, the modified fiber material according to the invention can be dyed merely using a purely aqueous dye solution in which only extremely small amounts of electrolyte salts (such as sodium chloride and sodium sulfate), which are present in the dye powders as standardizing agents, are additionally dissolved.

The present invention can advantageously also be used for single-bath dyeing processes for the dyeing of cellulose/polyester fiber blends if a disperse dye which is suitable for the dyeing of polyester fiber materials is additionally used together with a reactive dye in the joint dye bath. Since many disperse dyes are sensitive to alkali, particularly if elevated temperatures are employed, they cannot be used in the single-bath dyeing of cellulose/polyester fiber blend materials, since application of the high temperatures in the alkali-containing bath during dyeing of the polyester fiber with the disperse dye damages the disperse dyes. However, the present invention makes it possible to dye in the absence of alkali, so that in the aqueous, alkali-free dye liquor the reactive dye can be fixed on the modified fiber material first at low temperature, such as, for example, at a dyeing temperature of between 30° and 80° C., and the polyester fiber is then dyed with the disperse dye in the usual manner at temperatures above 100° C., such as, for example, between 110° and 140° C.

For the dyeing procedure according to the invention, any water-soluble, preferably anionic, dyes which preferably have one or more sulfo and/or carboxy groups and can, if desired, contain fiber-reactive groups are suitable. Apart from the class of fiber-reactive dyes, they can belong to the class of azo developing dyes, direct dyes, vat dyes and acid dyes, which can be, for example, azo dyes, copper complex azo dyes, cobalt complex azo dyes and chromium complex azo dyes, copper phthalocyanine dyes and nickel phthalocyanine dyes, anthraquinone, copper formazan and triphendioxazine dyes. Dyes of these types have been described in the literature in large numbers and are known to one skilled in the art in every respect.

Of the abovementioned dyes usable for the dyeing process according to the invention, the fiber-reactive dyes are preferably used. Fiber-reactive dyes are those organic dyes containing 1, 2, 3 or 4 fiber-reactive radicals from the aliphatic, aromatic or heterocyclic series. These dyes have been described in the literature in large numbers. The dyes can belong to a wide range of dye classes, such as, for example, to the class of monoazo, disazo, polyazo, metal complex azo, such as 1:1 copper complex, 1:2 chromium complex and 1:2 cobalt complex monoazo and disazo dyes, furthermore to the series of anthraquinone dyes, copper phthalocyanine dyes and cobalt phthalocyanine dyes, copper formazan dyes, azomethine, nitroaryl, dioxazine, triphendioxazine, phenazine and stilbene dyes. Fiber-reactive dyes are understood to mean those dyes containing a "fiber-reactive" group, i.e., a group which is capable of reacting with the hydroxy groups of cellulose, the amino, carboxy, hydroxy and thiol groups of wool and silk or with the amino and, if present, carboxy groups of synthetic polyamides to form covalent chemical bonds. The fiber-reactive radical can be bound to the dye radical directly or via a bridging member; preferably, it is bound to the dye radical directly or via an unsubstituted or monoalkylated amino group, such as, for example, a group of the formula —NH—, —$N(CH_3)$—, —$N(C_2H_5)$— or —$N(C_3H_7)$—, or via an aliphatic radical, such as a methylene, ethylene or propylene radical or an alkylene radical of 2 to 8 carbon atoms, which may be interrupted by one or two oxy and/or amino groups, or via a bridging member containing an amino group, such as, for example, a phenylamino group. Examples of fiber-reactive radicals are: vinylsulfonyl, β-chloroethylsulfonyl, β-sulfatoethylsulfonyl, β-acetoxyethylsulfonyl, β-phosphatoethylsulfonyl, β-thiosulfatoethylsulfonyl, N-methyl-N-(β-sulfatoethylsulfonyl)amino, acryloyl, —CO—CCl=$CH_2$, —CO—CH=CH—Cl, —CO—CCl=CHCl, —CO—CCl=CH—$CH_3$,—CO—CBr=$CH_2$, —CO—CH=CH—Br, —CO—CBr=CH—$CH_3$, —CO—CCl=CH—COOH, —CO—CH=CCl—COOH, —CO—CBr=CH—COOH, —CO—CH=CBr—COOH, —CO—CCl=CCl—COOH, —CO—CBr=CBr—COOH, β-chloro- or β-bromopropionyl, 3-phenylsulfonylpropionyl, 3-methylsulfonylpropionyl, 3-chloro-3-phenylsulfonylpropionyl, 2,3-dichloropropionyl, 2,3-dibromopropionyl, 2-fluoro-2-chloro-3,3-difluorocyclobutane-2-carbonyl, 2,2,3,3-tetrafluorocyclobutane-1-carbonyl or -1-sulfonyl, β-(2,2,3,3-tetrafluorocyclobutyl)acryloyl, α- or β-methylsulfonylacryloyl, propionyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl, 4-fluoro-3-nitrobenzoyl, 4-fluoro-3-nitrophenylsulfonyl, 4-fluoro-3-methylsulfonylbenzoyl, 4-fluoro-3-cyanobenzoyl, 2-fluoro-5-methylsulfonylbenzoyl, 2,4-dichloro-6-triazinyl, 2,4-dichloro-6-pyrimidinyl, 2,4,5-trichloro- 6-pyrimidinyl, 2,4-dichloro-5-nitro- or -5-methyl- or -5-carboxymethyl- or -5-carboxy- or -5-cyano- or -5-vinyl- or -5-sulfo- or -5-mono-, -di- or -trichloromethyl- or -5-methylsulfonyl-6-pyrimidinyl, 2,5-dichloro- 4-methylsulfonyl-6-pyrimidinyl, 2-fluoro-4-pyrimidinyl, 2,6-difluoro-4-pyrimidinyl, 2,6-difluoro-5-chloro- 4-pyrimidinyl, 2-fluoro-5,6-dichloro-4-pyrimidinyl, 2,6-difluoro-5-methyl-4-pyrimidinyl, 2,5-difluoro-6-methyl-4-pyrimidinyl, 2-fluoro-5-methyl-6-chloro- 4-pyrimidinyl, 2-fluoro-5-nitro-6-chloro-4-pyrimidinyl, 5-bromo-2-fluoro-4-pyrimidinyl, 2-fluoro-5-cyano- 4-pyrimidinyl, 2-fluoro-5-methyl-4-pyrimidinyl, 2,5,6-trifluoro-4-pyrimidinyl, 5-chloro-6-chloromethyl- 2-fluoro-4-pyrimidinyl, 2,6-difluoro-5-bromo- 4-pyrimidinyl, 2-fluoro-5-bromo-6-chloromethyl- 4-pyrimidinyl, 2,6-difluoro-5-chloromethyl-4-pyrimidinyl, 2,6-difluoro-5-nitro-4-pyrimidinyl, 2-fluoro-6-methyl- 4-pyrimidinyl, 2-fluoro-5-chloro-6-methyl-4-pyrimidinyl, 2-fluoro-5-chloro-4-pyrimidinyl, 2-fluoro-6-chloro- 4-pyrimidinyl, 6-trifluoromethyl-5-chloro-2-fluoro- 4-pyrimidinyl, 6-trifluoromethyl-2-fluoro-4-pyrimidinyl, 6-trifluoromethyl-2-fluoro-4-pyrimidinyl, 2-fluoro- 5-nitro-4-pyrimidinyl, 2-fluoro-5-trifluoromethyl- 4-pyrimidinyl, 2-fluoro-5-phenyl- or -5-methylsulfonyl- 4-pyrimidinyl, 2-fluoro-5-carboxamido-4-pyrimidinyl, 2-fluoro-5-carbomethoxy-4-pyrimidinyl, 2-fluoro-5-bromo- 6-trifluoromethyl-4-pyrimidinyl, 2-fluoro-6-carboxamido- 4-pyrimidinyl, 2-fluoro-6-carbomethoxy-4-pyrimidinyl, 2-fluoro-6-phenyl-4-pyrimidinyl, 2-fluoro-6-cyano- 4-pyrimidinyl, 2,6-difluoro-5-methylsulfonyl- 4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl, 2,4-di-(methylsulfonyl- 4-pyrimidinyl, 2,5-di-(methylsulfonyl)- 5-chloro-4-pyrimidinyl, 2-methylsulfonyl-4-pyrimidinyl, 2-phenylsulfonyl-4-pyrimidinyl, 2-methylsulfonyl-5-chloro-6-methyl-4-pyrimidinyl, 2-methylsulfonyl-5-bromo-6-methyl-4-pyrimidinyl, 2-methylsulfonyl-5-chloro-6-ethyl-4-pyrimidinyl, 2-methylsulfonyl- 5-chloromethyl-4-pyrimidinyl, 2-methylsulfonyl-5-nitro- 6-methyl-4-pyrimidinyl, 2,5,6-tri-methylsulfonyl- 4-pyrimidinyl, 2-methylsulfonyl-5,6-dimethyl- 4-pyrimidinyl, 2-ethylsulfonyl-5-chloro-6-methyl- 4-pyrimidinyl, 2-methylsulfonyl-6-chloro-4-pyrimidinyl, 2,6-di-(methylsulfonyl)-5-chloro-4-pyrimidinyl, 2-methylsulfonyl-6-carboxy-4-pyrimidinyl, 2-methylsulfonyl-5-sulfo-4-pyrimidinyl, 2-methylsulfonyl-6-carbomethoxy-4-pyrimidinyl, 2-methylsulfonyl-5-carboxy- 4-pyrimidinyl, 2-methylsulfonyl-5-cyano-6-methoxy-4-pyrimidinyl, 2-methylsulfonyl-5-chloro-4-pyrimidinyl, 2-sulfoethylsulfonyl-6-methyl-4-pyrimidinyl, 2-methylsulfonyl-5-bromo-4-pyrimidinyl, 2-phenylsulfonyl- 5-chloro-4-pyrimidinyl, 2-carboxymethylsulfonyl-5-chloro- 6-methyl-4-pyrimidinyl, 2,4-dichloropyrimidine-6-carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio- 4-fluoropyrimidine-5-carbonyl, 6-methyl- 2,4-dichloropyrimidine-5-carbonyl, 2,4,6-trichloropyrimidine-5-carbonyl, 2,4-dichloropyrimidine-5-sulfonyl, 2,4-dichloro-6-methylpyrimidine- 5-carbonyl or -5-sulfonyl, 2-methylsulfonyl- 6-chloro- pyrimidin-4- and -5-carbonyl, 2,6-di-(methyl-sulfonyl)-pyrimidin- 4- or -5-carbonyl, 2-ethylsulfonyl- 6-chloropyrimidine-5-carbonyl, 2,4-di-(methylsulfonyl)pyrimidine- 5-sulfonyl, 2-methylsulfonyl-4-chloro- 6-methylpyrimidine-5-sulfonyl- or -5-carbonyl, 2-chloroquinoxaline- 3-carbonyl, 2- or 3-monochloroquinoxaline- 6-carbonyl, 2- or 3-monochloroquinoxaline-6-sulfonyl, 2,3-dichloroquinoxaline-5- or -6-carbonyl, 2,3-dichloroquinoxaline- 5- or -6-sulfonyl, 1,4-dichlorophthalazine- 6-sulfonyl or -6-carbonyl, 2,4-dichloroquinazoline-7- or -6-sulfonyl or -carbonyl, 2,4,6-trichloroquinazoline-7- or -8-sulfonyl, 2- or 3- or 4-(4',5'-dichloro- 6'-pyridazon-1'-yl)-phenylsulfonyl or -carbonyl, β-(4',5'-dichloro-6'-pyridazinon-1'-yl)-propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or 2-alkylsulfonylbenzothiazole-5- or -6-carbonyl or -5- or -6-sulfonyl, such as 2-methylsulfonyl- or 2-ethylsulfonylbenzothiazole- 5- or -6-sulfonyl or -carbonyl, 2-phenylsulfonylbenzothiazole-5- or -6-sulfonyl or -carbonyl and the corresponding 2-sulfonylbenzothiazole- 5- or -6-carbonyl or -sulfonyl derivatives containing sulfo groups in the fused-on benzene ring, 2-chlorobenzoxazole- 5- or -6-carbonyl or -sulfonyl, 2-chlorobenzimidazole- 5- or -6-carbonyl or -sulfonyl, 2-chloro- 1-methylbenzimidazole-5- or -6-carbonyl or -sulfonyl, 2-chloro-4-methyl-1,3-thiazole-5-carbonyl or -4- or -5-sulfonyl; triazine rings containing ammonium groups, such as 2-trimethylammonio-4-phenylamino- and -4-(o-, m- or p-sulfophenyl)amino-6-triazinyl, 2-(1,1-dimethylhydrazinio)- 4-phenylamino- and -4-(o-, m- or p-sulfophenyl)amino- 6-triazinyl, 2-(1,1-dimethyl-2-prop-2'-yl-hydrazinio)- 4-phenylamino-6-triazinyl and -4-(o-, m- or p-sulfophenyl)amino-6-triazinyl, 2-N-aminopyrrolidinio-, 2-N-aminopiperidinio-4-phenylamino- or -4-(o-, m- or p-sulfophenyl)amino-6-triazinyl, 4-phenylamino- or 4-(sulfophenylamino)-6-triazinyl which contain 1,4-bis-azabicyclo[ 2.2.2]octane or 1,2-bisazabicyclo[0.3.3] octane bound in quaternary form in the 2 position via a nitrogen bond, 2-pyridinio-4-phenylamino- or -4-(o-, m- or p-sulfophenyl)amino-6-triazinyl and the corresponding 2-onium-6-triazinyl radicals substituted in the 4-position by alkylamino, such as methylamino, ethylamino or β-hydroxyethylamino, or alkoxy, such as methoxy or ethoxy, or aryloxy, such as phenoxy or sulfophenoxy.

Particularly interesting fiber-reactive radicals are fluoro- and chloro-1,3,5-triazine radials of the formula (2)

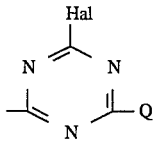

(2)

in which Hal is chlorine or fluorine and Q is an amino, alkylamino, N,N-dialkylamino, cycloalkylamino, N,N-dicycloalkylamino, aralkylamino, arylamino, N-alkyl-N-cyclohexylamino, N-alkyl-N-arylamino group or an amino group containing a heterocyclic radical, which may have a further fused-on carbocyclic ring, or is an amino group in which the amino nitrogen atom is a member of an N-heterocyclic ring which, if desired, contains further hetero atoms, or is a hydrazine or semicarbazide group, it being possible for the alkyl radicals mentioned to be straight-chain or branched and of low molecular weight or high molecular weight, these radicals preferably being those having 1 to 6 carbon atoms. Suitable cycloalkyl, aralkyl and aryl radicals are in particular cyclohexyl, benzyl, phenethyl, phenyl and naphthyl radicals; heterocyclic radicals are in particular furan, thiophene, pyrazole, pyridine, pyrimidine, quinoline, benzimidazole, benzothiazole and benzoxazole radicals. Suitable amino groups in which the amino nitrogen atom is a member of an N-heterocyclic ring are preferably radicals of six-membered N-heterocyclic compounds, which may contain nitrogen, oxygen or sulfur as further hetero atoms. The abovementioned alkyl, cycloalkyl, aralkyl and aryl radicals, the heterocyclic radicals and the N-heterocyclic rings can additionally be substituted, for example by halogen, such as fluorine, chlorine and bromine, nitro, cyano, trifluoromethyl, sulfamoyl, carbamoyl, $C_1$–$C_4$-alkyl, $C_1$–$C_4$-alkoxy, acylamino groups, such as acetylamino or benzoylamino, ureido, hydroxy, carboxy, sulfomethyl or sulfo. Examples of such amino groups include: $NH_2$, methylamino, ethylamino, propylamino, isopropylamino, butylamino, hexylamino, β-methoxyethylamino, γ-methoxypropylamino, β-ethoxyethylamino, N,N-dimethylamino, N,N-diethylamino, β-chloroethylamino, β-cyanoethylamino, γ-cyanopropylamino, β-carboxyethylamino, sulfomethylamino, β-sulfoethylamino, β-hydroxyethylamino, N,N-di-β-hydroxyethylamino, γ-hydroxypropylamino, benzylamino, phenethylamino, cyclohexylamino, phenylamino, toluidino, xylidino, chloroanilino, anisidino, phenetidino, N-methyl-N-phenylamino, N-ethyl-N-phenylamino, N-β-hydroxyethyl-N-phenylamino, 2-, 3- or 4-sulfoanilino, 2,5-disulfoanilino, 4-sulfomethylanilino, N-sulfomethylanilino, 2-, 3- or 4-carboxyphenylamino, 2-carboxy-5-sulfophenylamino, 2-carboxy-4-sulfophenylamino, 4-sulfonaphthyl-1-amino, 3,6-disulfonaphthyl- 1-amino, 3,6,8-trisulfonaphthyl-1-amino, 4,6,8-trisulfonaphthyl- 1-amino, 1-sulfonaphthyl-2-amino, 1,5-disulfonaphthyl-2-amino, 6-sulfonaphthyl-2-amino, morpholino, piperidino, piperazino, hydrazino and semicarbazido.

Furthermore, Q can be an amino radical of the formula —$NR^{10}R^{11}$, in which $R^{10}$ is hydrogen or alkyl of 1 to 4 carbon atoms, such as methyl or ethyl, and $R^{11}$ is phenyl which is substituted directly or via a methylamino, ethylamino, methylene, ethylene or propylene group by a fiber-reactive radical from the vinylsulfonyl series and can additionally be substituted by 1 or 2 substituents from the group comprising methoxy, ethoxy, methyl, ethyl, chlorine, carboxy and sulfo, or $R^{11}$ is alkyl of 2 to 4 carbon atoms, such as ethyl or n-propyl which is substituted by a fiber-reactive group from the vinylsulfonyl series, or is alkylenephenyl having an alkylene radical of 1 to 4 carbon atoms whose phenyl is substituted by a fiber-reactive radical from the vinylsulfonyl series, or in which $R^{10}$ and $R^{11}$ are both alkyl of 2 to 4 carbon atoms, such as ethyl and n-propyl which are substituted by a fiber-reactive group from the vinylsulfonyl series, or in which $R^{10}$ and $R^{11}$ are both alkylene of 3 to 8 carbon atoms which are interrupted by 1 or 2 oxy and/or amino groups and to which a fiber-reactive group from the vinylsulfonyl series is bound in the terminal position. Fiber-reactive groups from the vinylsulfonyl series are those of the formula —$SO_2$—Y, in which Y is vinyl or ethyl substituted in the β position by a substituent which can be eliminated by alkali, such as, for example, by chlorine, sulfato, phosphato, thiosulfato, acetyloxy, sulfobenzoyloxy and dimethylamino.

The dyeings, of the modified cellulose fiber materials, obtainable by the procedure according to the invention do not require any further aftertreatment after removal from the dye bath or after fixation of the dye on the substrate is complete; in particular they do not require any complicated aftertreatment process including a wash. As a rule, all that is required is a customary single or multiple rinsing of the dyed substrate with warm or hot and, if desired, cold water which, if desired can contain a nonionic wetting agent or a fiber-reactive aftertreatment agent, such as, for example, condensation products obtained from one mole of cyanuric chloride and two moles of 4-(β-sulfatoethylsulfonyl)aniline, from equivalent amounts of cyanuric chloride, 4-(β-sulfatoethylsulfonyl )aniline and 4,8-disulfo- 2-aminonaphthalene or from equivalent amounts of cyanuric chloride, 4-sulfoaniline and 4,8-disulfo- 2-aminonaphthalene. The use of a fiber-reactive aftertreatment agent is recommended in those cases where the fiber material modified according to the invention was only dyed in low color depths or a dye was used which does not have satisfactory dye reactivity. In these cases, a sufficient number of active dyeing sites are still present on the modified fiber which, for example, are capable of reacting with other dyes present in rinsing baths contaminated with these dyes. This aftertreatment deactivates the still active sites of the fiber modified according to the invention, as a result of which the originally desired clear dyeing is obtained even if the rinsing water was used in an industrial process and is contaminated with dyes. Moreover, a final treatment of the dyed substrate at the boil with a washing solution in order to improve the fastness properties is not necessary.

The Examples which follow serve to illustrate the invention. The parts and percentages given therein are by weight unless stated otherwise. Parts by weight relate to parts by volume as the kilogram relates to the liter.

EXAMPLE A 500 parts by volume of N-(β-hydroxyethyl)piperidine are slowly added with stirring to a mixture of 750 parts by volume of 100% sulfuric acid and 75 parts by volume of sulfuric acid containing 20% of sulfur trioxide (20% oleum) at 10° C., the reaction temperature being maintained between 20° and 25° C. with constant cooling. After reaction is complete, the reaction mixture is stirred into 1000 parts of ice-water, the pH is brought to 4 with calcium carbonate, the batch is heated to 50° C. for a short period, and the calcium sulfate formed is then filtered off. Any calcium ions still present are precipitated from the filtrate using sodium oxalate. After the calcium oxalate has been separated off, the aqueous solution of the N-(β-sulfatoethyl)piperidine is evaporated to dryness under reduced pressure, giving a yellow, oily product which crystallizes and melts at 124° C. with decomposition.

$^1$H NMR analysis (in hexadeutero-dimethyl sulfoxide; 300 Hz): 1.5 ppm (d, br, 2H); 1.7 ppm (t, 4H); 3.15 ppm (s, 4H); 3.25 ppm (t, 2H); 4.15 ppm (t, 2H).

EXAMPLE B

To prepare a mixture of compounds 3-sulfato-2-hydroxy-1-aminopropane and 2-sulfato-3-hydroxy-1-aminopropane, 92.9 parts of 2,3-dihydroxy-1-aminopropane are introduced into 98 parts of 96% sulfuric acid with stirring, the reaction temperature being maintained at 20° to 25° C. by external cooling. Workup of the reaction mixture and isolation of the sulfato-hydroxy-1-aminopropanes take place in the same manner as described in Example A.

EXAMPLE C 100 parts of 2,3-dihydroxypropyltrimethylammonium chloride are slowly introduced into 110 parts of 100% sulfuric acid at a temperature of 20° C. with stirring, stirring of the batch is continued for a few hours in order to complete the reaction, and the ester compound formed is isolated in the manner described in Example A. An oily product is obtained as a mixture of 3-sulfato- 2-hydroxypropyltrimethylammonium sulfate and 2-sulfato- 3-hydroxypropyltrimethylammonium sulfate.

$^1$H NMR analysis (in hexadeutero-dimethyl sulfoxide; 300 Hz): 3.68 and 3.8 ppm (2dd, 2H); 2.94 and 2.7 ppm (2dd, 2H); 4.3 ppm (m, 1H).

EXAMPLE D

In order to prepare N-(γ-sulfato-β-hydroxypropyl)piperidine, 100 parts of N-(β,γ-dihydroxypropyl)piperidine are slowly added to 67 parts of 100% sulfuric acid at 20° C. with stirring. Stirring of the batch is continued for a few hours, and the piperidine compound according to the invention is isolated in the manner described in Example A. It is first obtained as an oily product which crystallizes after some time. It melts at 170° to 175° C. with decomposition.

$^1$H NMR analysis (in hexadeutero-dimethyl sulfoxide; 300 Hz): 1.5 ppm (s, br, 2H); 3.1–3.3 ppm (m, 8H); 3.0/3.15 ppm (2dd, 2H); 3.68/3.8 ppm (2dd, 2H); 4.1 ppm (m, 2H).

EXAMPLE E

In order to prepare N-(γ-sulfato-β-hydroxypropyl)pyrrolidine, 50 parts of N-(β,γ-dihydropxypropyl)pyrrolidine are slowly added to 98 parts of 100% sulfuric acid at 20° C. with stirring. Stirring of the batch is continued for a few hours, and the compound formed is then isolated as an oily product in the manner described in Example A.

$^1$H NMR analysis (in $D_6$-dimethyl sulfoxide): 4.0 ppm (m, 1H); 3.76/3.68 ppm (2dd, 2H); 3.0 ppm (m, 2H); 1.95 ppm (s, br, 4H); 3.1 ppm (s, br, 4H).

EXAMPLE 1 a) A fabric comprising mercerized and bleached cotton is impregnated with a warm aqueous solution at 20° to 25° C. containing 50 parts of sodium hydroxide and 50 parts of 1-N-(β-sulfatoethyl)piperazine in 1000 parts of water at a liquor pickup of 90%. The material is then treated with hot air at 150° C. for 2.5 minutes, which results not only in drying but also in fixing of the piperazine compound on the fabric. The material thus obtained is then treated in cold water and in hot water at 60° C. and, if desired, in an aqueous bath containing acetic acid until any residual alkali has been removed from the fabric.

b) The modified cotton fabric is then dyed by a method analogous to the customary exhaust method: 100 parts of the modified fabric are introduced into 2000 parts by volume of an aqueous solution containing 2 parts of a 50% electrolyte-containing (predominantly sodium chloride containing) dye powder of the dye of the formula

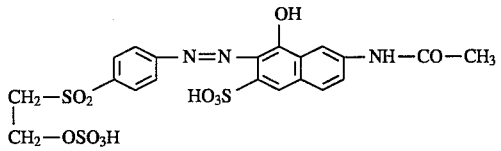

disclosed, for example, in published European Patent Application No. 0,061,151 in the form of the alkali metal salt (i.e. 1 part of this dye and 1 part of the electrolyte), the dye bath is heated to 60° C. over a period of 30 minutes, and the dyeing process is continued at this temperature for 60 minutes. The dyed fabric is then rinsed with cold and with hot water, it being possible for the hot water to contain a commercially available wetting agent, and, if desired, again rinsed with cold water and dried.

This produces a level orange dyeing of high color strength and good general fastness properties, in particular good rub and light fastness properties.

EXAMPLE 2 a) A mercerized and bleached cotton fabric is padded with an aqueous solution of 50 parts of sodium hydroxide and 50 parts of 1-N-(β-sulfatoethyl)piperazine in 1000 parts of water at a temperature of 25° to 30° C. and a liquor pickup of 85% on a pad-mangle. The fabric thus treated is then treated with hot air at 150° C. for about 3 minutes in order to fix the piperazine compound on the cellulose fiber and to dry the padded fabric at the same time. To remove the alkali, the modified fabric is then treated in baths with cold water and with hot water at 60° C. and dried.

b) The modified cotton fabric is then dyed by a cold pad-batch method. To this end, an aqueous solution containing, in 1000 parts by volume, 20 parts of the dye powder described in Example 1, 100 parts of urea and 3 parts of a commercially available nonionic wetting agent, is applied to the fabric at 25° C. and at a liquor pickup of 80%, relative to the weight of the fabric, by means of a pad-mangle. The fabric padded with the dye solution is wound onto a batching roller, wrapped in a plastic sheet and left at 20° to 25° C. for 16 hours and then rinsed with cold and with hot water which, if desired, may contain a commercially available wetting agent, and, if desired, then rinsed again with cold water and dried.

This produces a level orange dyeing of high color strength and good general fastness properties, in particular good rub and light fastness properties.

EXAMPLE 3 a) A fabric comprising mercerized and bleached cotton is padded with a warm aqueous solution at 20° to 25° C. containing 50 parts of sodium hydroxide and 50 parts of the monosulfate of 2,3-dihydroxy-1-aminopropane in 1000 parts of water at a liquor pickup of 90%. The impregnated material is then treated with hot air at 150° C. for 2.5 minutes in order to fix the aminopropane compound on the material with simultaneous drying and then washed in cold water and in hot water at 60° C. until excess alkali has been completely removed and is then dried.

b) The fabric thus modified is then dyed by a customary padding method, for example analogously to the procedure of Example 2. To this end, an aqueous solution containing, in 1000 parts by volume, 28 parts of a 50% electrolyte-containing (predominantly sodium chloride containing) dye powder of the dye of the formula

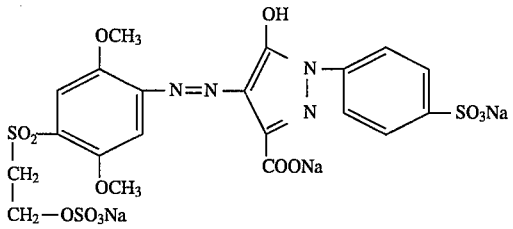

disclosed, for example, in Belgian Patent No. 715,420, and 3 parts of a commercially available nonionic wetting agent, is applied to the fabric at 20° C. and a liquor pickup of 80%, relative to the weight of the fabric, by means of a pad-mangle. The padded fabric is then wound onto a batching roller, wrapped in a plastic sheet and left at 20° C. for 16 hours and then washed with cold and with hot water which, if desired, may contain a commercially available nonionic surfactant and, if desired, again washed with cold water and dried.

This produces a level yellow dyeing of high color strength and the customary good fastness properties.

EXAMPLE 4

A mercerized and bleached cotton fabric is impregnated with an aqueous solution of 50 parts of sodium hydroxide and 100 parts of the monosulfate of 2,3-dihydroxy- 1-aminopropane in 1000 parts of water at a temperature of between 25° and 30° C. and a liquor pickup of 85% and then treated with hot air at 150° C. for about 3 minutes in order to fix the aminopropane compound on the fiber material, which simultaneously results in drying of the impregnated fabric. The modified material is then freed from excess alkali by a treatment with cold water and with hot water of 60° C.

The dried material thus modified is dyed by a customary exhaust method. To this end, 10 parts of this material are introduced into 200 parts by volume of an aqueous dye solution containing 0.2 part of a 50% electrolyte-containing dye powder of the dye of the formula

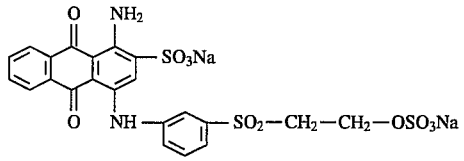

disclosed in German Offenlegungsschrift No. 2,412,964 in dissolved form. Dyeing is carried out at 60° C. for 60 minutes. The dyed fabric is then rinsed with cold water and with hot water at 30° to 35° C. which, if desired, may contain a commercially available nonionic surfactant, and then, if desired, again washed with cold water and dried.

This produces a blue dyeing of high color strength which, in terms of fastness properties and other qualities, is similar to dyeings obtained by the customary dyeing methods of the prior art.

EXAMPLE 5

A cotton fabric modified by the procedure of Example 3a) is dyed by a cold pad-batch dyeing method. To this end, an aqueous solution containing, in 1000 parts by volume, 20 parts of a 50% electrolyte-containing dye powder of the copper phthalocyanine dye of the formula

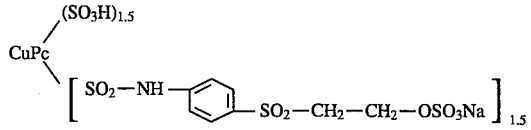

disclosed, for example, in German Patent No. 1,179,317 and 3 parts of a commercially available nonionic wetting agent is applied to the fabric at 25° C. at a liquor pickup of 80%, relative to the weight of the fabric, by means of a pad-mangle. The fabric padded with the dye solution is wound onto a batching roller, wrapped in a plastic sheet and left at 20° to 25° C. for 16 hours and then rinsed with cold and with hot water which, if desired, may contain a commercially available wetting agent and, if desired, then again rinsed with cold water and dried.

This produces a level turquoise dyeing of high color strength and good general fastness properties, in particular good rub and light fastness properties.

EXAMPLE 6

A cotton fabric modified by the procedure of Example 1a) is printed with an aqueous printing paste containing, in 1000 parts, 20 parts of the dye of the formula

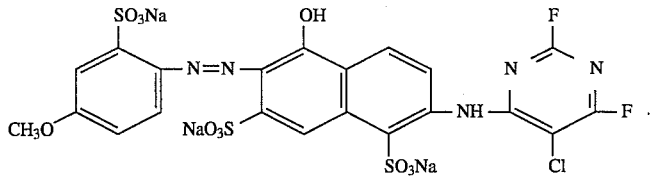

(disclosed in Example 258 of German Offenlegungsschrift No. 1,644,204) and 400 parts of an approximately 4% aqueous sodium alginate thickener. The printed cotton fabric is first dried at 60° to 80° C. and then steamed with hot steam at 101° to 103° C. for 5 minutes, then rinsed with cold and with hot water, subjected to a treatment at the boil in a bath containing a neutral, nonionic detergent, again rinsed with cold and hot water and dried. This produces a level scarlet-colored print having good wear fastness properties.

EXAMPLE 7

A cotton fabric modified by the procedure of Example 1a) is printed with an aqueous printing paste containing, in 1000 parts, 20 parts of the dye of the formula

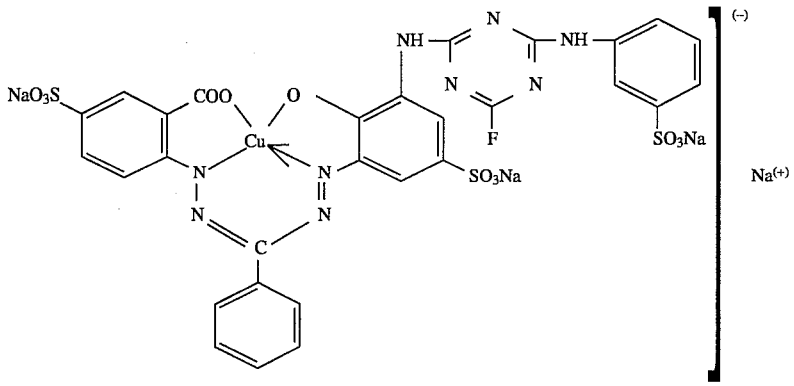

(disclosed in Example 3 of German Offenlegungsschrift No. 2,557,141) and 400 parts of an aqueous, 4% sodium alginate thickener. The printed fabric is first dried at about 60° to 80° C. and then steamed with hot steam at 101° to 103° C. for 5 minutes. The print obtained, which is finished by the procedure of Example 6, shows a brilliant, blue printing pattern which has good general fastness properties, in particular good rub and light fastness properties.

EXAMPLE 8

10 parts of a cotton fabric modified by the procedure of Example 1a) are introduced into 200 parts of an aqueous solution of 0.2 part of the dye of the formula

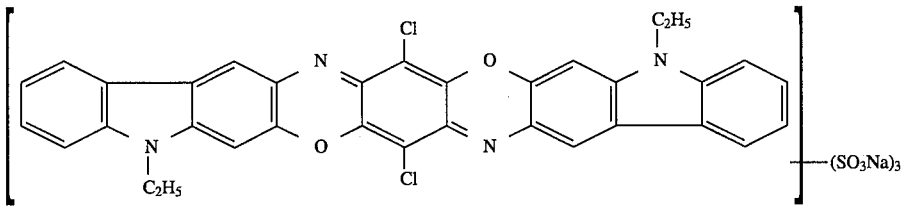

(disclosed in Colour Index under C.I. No. 51320). The cotton fabric is dyed in this dye solution at 60° C. for 60 minutes. The aftertreatment of the dyeing obtained is carried out in the usual manner, such as, for example, analogously to the procedure of Example 6. This produces a blue dyeing of high color strength and very good wear fastness properties, such as, in particular, good wash fastness.

EXAMPLE 9

10 parts of a cotton fabric modified by the procedure of Example 1a) are added to 200 parts of an aqueous solution of 0.2 part of the copper phthalocyanine dye of the formula

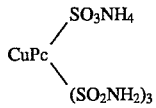

disclosed, for example, in British Patent No. 1,046,520 and dyed at a dyeing temperature of 80° C. for 60 minutes. The dyeing obtained is then rinsed with cold water and with hot water at 30° to 35° C. which may contain a commercially available nonionic surfactant, and then again with cold water and dried, giving a high-quality turquoise dyeing having good fastness properties.

EXAMPLE 10 a) A fabric comprising mercerized and bleached cotton is padded with a solution of 50 parts of N-(β-sulfatoethyl)piperidine and 50 parts of sodium hydroxide in 1000 parts of water at 20° to 25° C. and a liquor pickup of 75%, relative to the weight of the fabric. The padded fabric is then subjected to a treatment with hot air at 180° C. for 45 seconds, as a result of which the fabric is dried and the piperidine compound is simultaneously fixed on the material. The material thus modified is washed with cold and hot water at 60° C. in order to remove excess alkali.

b) The modified cotton fabric is dyed by a method analogous to a customary exhaust method: 100 parts of the modified fabric are added to 2000 parts by volume of an aqueous dye solution containing 2 parts of the dye powder used in Example 1 in dissolved form; the dye bath is heated to 60° C. over a period of 30 minutes, and the dyeing process is continued at this temperature for 60 minutes. The dyed fabric is then rinsed with cold and with hot water, it being possible for the hot water to contain a commercially available wetting agent, and, if desired, again rinsed with cold water and dried.

This produces a level orange dyeing of high color strength and good general fastness properties, in particular good rub and light fastness properties.

EXAMPLE 11 a) A mercerized and bleached cotton fabric is impregnated with an aqueous solution of 50 parts of 3-sulfato-2-hydroxypropyltrimethylammonium sulfate or of 50 parts of a mixture of 3-sulfato-2-hydroxypropyltrimethylammonium sulfate and 2-sulfato- 3-hydroxypropyltrimethylammonium sulfate and of 25 parts of sodium hydroxide in 1000 parts at a temperature of 25° to 30° C. and a liquor pickup of 85%. Fixation of the sulfato compound(s) on the cotton fiber and simultaneous drying of the padded fabric are effected by a treatment of the padded fabric with hot air at 150° C. lasting 150 to 180 seconds. The modified fabric is then subjected to a washing process with cold water and with hot water at 60° C.

b) The modified cotton fabric is then dyed by a cold pad-batch dyeing method. To this end, an aqueous solution containing, in 1000 parts by volume, 20 parts of the dye powder described in Example 1, 100 parts of urea and 3 parts of a commercially available nonionic wetting agent, is applied to the fabric at 25° C. and a liquor pickup of 80%, relative to the weight of the fabric, by means of a pad-mangle. The fabric padded with the dye solution is wound onto a batching roller, wrapped in a plastic sheet and left at 20° to 25° C. for 16 hours and then rinsed with cold and with hot water which, if desired, may contain a commercially available wetting agent, and, if desired, then again rinsed with cold water and dried.

This produces a level orange dyeing of high color strength and good general fastness properties, in particular good rub and light fastness properties.

EXAMPLE 12 a) A fabric comprising mercerized and bleached cotton is padded with a warm solution at 20° to 25° C. comprising 50 parts of N-(γ-sulfato-β-hydroxypropyl)piperidine and 50 parts of sodium hydroxide in 1000 parts of water at a liquor pickup of 75%, relative to the weight of the fabric. The impregnated material is then dried with hot air at 150° C. for about 2.5 minutes, which simultaneously results in fixation of the piperidine compound on the fiber material. The modified material is then washed with cold and hot water and dried.

b) The fabric thus modified is dyed by a customary padding method, for example analogously to the procedure of Example 11. To this end, an aqueous solution containing, in 1000 parts by volume, 28 parts of the dye powder described in Example 3 and 3 parts of a commercially available nonionic wetting agent, is applied to the fabric at 20° C. and a liquor pickup of 80%, relative to the weight of the fabric, by means of a pad-mangle. The padded fabric is then wound onto a batching roller, wrapped in a plastic sheet and left at 30° to 40° C. for eight hours and then washed with cold and with hot water which, if desired, may contain a commercially available nonionic surfactant and, if desired, again washed with cold water and dried.

This produces a level yellow dyeing of high color strength and the customary good fastness properties.

EXAMPLE 13 a) A mercerized and bleached cotton fabric is impregnated with a solution of 100 parts of N-(γ-sulfato-β -hydroxypropyl)pyrrolidine and 100 parts of sodium hydroxide in 1000 parts of water at 20° to 25° C. and a liquor pickup of 85%. Fixation of the pyrrolidine compound on the fiber material and simultaneous drying of the padded fabric are effected by treatment with hot air at 180° C. for 45 seconds. The modified material is then subjected to a washing process with cold and hot water.

b) The modified fabric is dyed by a customary exhaust method. To this end, 10 parts of the fabric are introduced into 200 parts by volume of an aqueous dye solution containing 0.2 part of a 50% electrolyte-containing (predominantly sodium chloride containing) dye powder of the dye disclosed in Example 1 of European Patent No. 0,032,187.

Dyeing is carried out at 60° C. for 60 minutes. The dyed fabric is then rinsed with cold water and with hot water at 30° to 40° C. which, if desired, contains a commercially available nonionic surfactant, and, if desired, then again washed with cold water and dried.

This produces a red dyeing of high color strength which, in terms of the fastness properties and qualities, is similar to dyeings obtained by the customary dyeing procedures of the prior art.

EXAMPLE 14

A knitted cotton fabric is treated with a solution of 50 parts of N-(β-sulfatoethyl)piperidine and 50 parts of sodium hydroxide in 1000 parts of water at 130° C. at a liquor ratio of 20:1 for 30 minutes by a customary exhaust method. The modified material is then washed with cold water and with hot water at 60° C., in order to remove excess alkali, and dried.

The modified cotton fabric obtained is dyed by a customary exhaust method:

100 parts of the fabric are introduced into 2000 parts by volume of an aqueous dye solution containing 2 parts of the 50% electrolyte-containing dye powder described in Example 1 in dissolved form. The fabric is agitated therein, and the dye bath is heated to 60° C. over a period of 30 minutes, and the dyeing is then continued at 60° C. for 60 minutes. The dyed material is removed from the bath and rinsed with cold and with hot water, if appropriate with the addition of a commercially available wetting agent, and, if desired, then again rinsed with cold water and dried.

This produces a level orange dyeing of high color strength and good general fastness properties, in particular good rub and light fastness properties.

EXAMPLE 15

10 parts of a knitted cotton fabric are treated in 200 parts of an aqueous solution of 10 parts of 3-sulfato- 2-hydroxypropyltrimethylammonium sulfate and 5 parts of sodium hydroxide at 130° C. in a pressurized vessel for 30 minutes. The modified material is then intensively washed and dried. 10 parts of this modified cotton fabric are dyed in 200 parts of an aqueous solution of 0.2 part of the dye of the formula

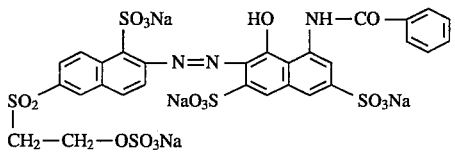

disclosed, for example, in German Offenlegungsschrift No. 1,943,904 at 60° C. for 60 minutes. The dyeing obtained is then rinsed with cold water and with hot water at 30° to 35° C. which may contain a commercially available nonionic surfactant and then again rinsed with cold water and dried. This produces a high-quality red dyeing of good fastness properties.

EXAMPLE 16 a) A fabric comprising mercerized and bleached cotton is impregnated with a warm aqueous solution at 20° to 25° C. comprising 60 parts of N-(β-sulfatoethyl)piperidine and 50 parts of sodium hydroxide in 1000 parts of water and a liquor pickup of 90% and then subjected to a treatment with hot air at 170° C. for 60 seconds. This results in drying of the fabric and simultaneous fixation of the piperidine compound on the fiber material. The material thus treated is then thoroughly washed with cold and hot water and dried.

b) The modified fabric is then printed with a printing paste containing, in 1000 parts, 20 parts of the dye disclosed in Example 1 of published European Patent Application No. 0,228,348 and 400 parts of a neutral sodium alginate thickener. The printed fabric is steamed with hot steam at 101° to 103° C. for 5 minutes. The modified fabric is finished analogously to the procedure described in the previous Examples. This produces a brilliant, blue printing pattern having good general fastness properties, such as, in particular, good rub and light fastness properties.

EXAMPLE 17

A fabric comprising mercerized and bleached cotton is impregnated with a warm aqueous solution at 20° to 25° C. comprising 50 parts of N-(γ-sulfato-β-hydroxypropyl)piperidine and 50 parts of sodium hydroxide in 1000 parts of water and a liquor pickup of 90% and then subjected to a treatment with hot air at 150° C. for 2.5 minutes, then thoroughly rinsed with cold and hot water and dried.

The modified cotton fabric obtained is dyed by a customary exhaust method:

10 parts of the material are introduced into 200 parts by volume of an aqueous dye solution containing 0.2 part of the dye disclosed in Example 1 of European Patent No. 0,032,187, the dye liquor is heated to 60° C., and dyeing is continued at this temperature for another 60 minutes. The dyed fabric is then rinsed with cold and hot water which may contain a commercially available wetting agent and, if desired, again rinsed with cold water and dried. This produces a deep red dyeing having very good wear fastness properties.

EXAMPLE 18 a) 100 parts of a knitted cotton fabric are treated with 1500 parts of an aqueous liquor of 75 parts of N-(β-sulfatoethyl)piperazine and 45 parts of sodium hydroxide in a jet-dyeing machine with continuous movement of the goods by heating the machine to 130° C. and causing the material to come under the action of the liquor at this temperature for 30 minutes. The liquor is then cooled to 80° C., discharged from the machine, and the material thus modified is thoroughly rinsed in the machine first with cold and then with hot water to which a commercially available wetting agent may have been added and then again with cold water.

b) 2000 parts of water are then run into the jet-dyeing machine and heated to 60° C. A total of 20 parts of a 50% electrolyte-containing (predominantly sodium chloride containing) dye powder of the azo dye described in Example 15 are then metered in over a period of 60 minutes, dyeing is then continued for about 5 minutes, and the colorless residual liquor is then discharged from the machine. The dyed knitted fabric is finished in the usual manner by rinsing with cold and hot water, by a treatment at the boil in a bath containing a nonionic detergent, by rinsing once again with hot and cold water and drying. This produces a deep red dyeing of high color strength and very good wear fastness properties.

EXAMPLE 19 a) 10 parts of a polyester/cotton blend fabric are treated with an aqueous solution containing 50 parts of N-(β-sulfatoethyl)piperazine and 20 parts of sodium hydroxide per 1000 parts of water at 95° C. and a liquor ratio of 10:1 for 15 minutes by a customary exhaust method. The modified fabric was then thoroughly rinsed with cold and hot water to which a commercially available nonionic surfactant may have been added and rinsed once again with cold water.

b) The modified goods can be transferred while wet to a single-bath dyeing process in a jet-dyeing machine. To this end, 10 parts of the modified blend fabric are heated in the machine to 60° C. together with 0.1 part of a 50% electrolyte-containing fiber-reactive azo dye described in Example 1 of European Patent 0,032,187 and 0.1 part of the disperse dye of the formula

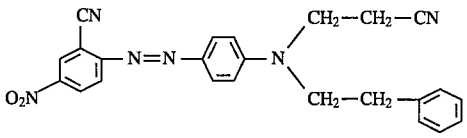

disclosed, for example, in German Offenlegungsschrift No. 2,363,376 in 200 parts of water, maintained at this temperature for 15 minutes and then heated to 130° C. Dyeing is carried out at 130° C. for 30 minutes, the mixture is cooled to 60° C., the dye liquor which is now colorless is discharged, and the dyed material is washed in the usual manner, for example by rinsing with cold and hot water, by a treatment at the boil in a bath containing a nonionic detergent, by rinsing once again with water and drying.

This produces a level red dyeing of high color strength whose fastness properties are equal in all respects to the fastness properties of dyeings obtainable by prior art processes.

EXAMPLE 20

A polyester/cotton blend fabric modified according to Example 19a) is treated with an aqueous dye liquor containing, relative to the weight of the dry fabric, 1.5% of the

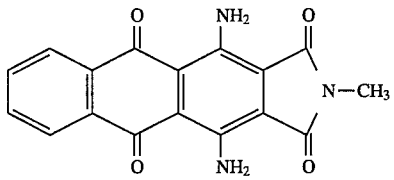

disclosed, for example, in published Japanese Patent Application Sho-54/069,139 and the fiber-reactive copper phthalocyanine dye of the formula

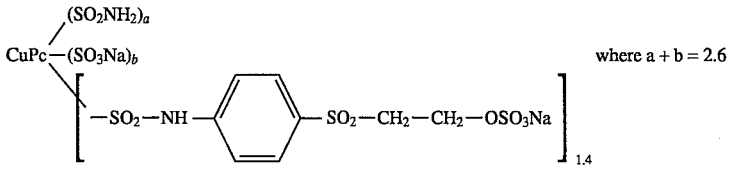

disperse dye of the formula

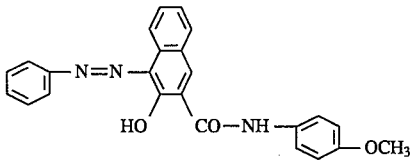

disclosed, for example, in German Auslegeschrift No. 1,131,639, and 1.5% of the fiber-reactive azo dye described in Example 1, in a HT-dyeing apparatus. Dyeing is first carried out at 60° C. for 30 minutes and then, after increasing the temperature to 130° C., at this temperature for another 30 minutes. The dyeing obtained is then finished in the manner described in Example 19b). This produces a vivid orange dyeing on both fiber portions.

EXAMPLE 21

The procedure of Example 20 for producing a dyeing of a polyester/cotton blend fabric is repeated, except that the disperse dye of the formula disclosed, for example, in German Auslegeschrift No. 1,283,997 are used, giving, after customary finishing, a vividly blue-colored blend fabric with a very level dyeing and high wear fastness properties.

EXAMPLE 22 a) A package containing 30 parts of bleached cotton yarn is treated in a yarn-dyeing apparatus in 450 parts of an aqueous solution of 50 parts of N-(β-sulfatoethyl)piperazine and 30 parts of sodium hydroxide in 1000 parts of water at a temperature of 130° C. for 30 minutes with alternating recirculation of the liquor through the package. The liquor is then cooled and discharged, and the package is thoroughly rinsed with cold and hot water to which a nonionic surfactant may have been added.

b) After a repeated rinsing step with cold water, the yarn is subjected directly to a dyeing process on the package:

The dyeing apparatus is charged with 450 parts of an aqueous dye solution containing 0.6 part of the fiber-reactive azo dye of the formula

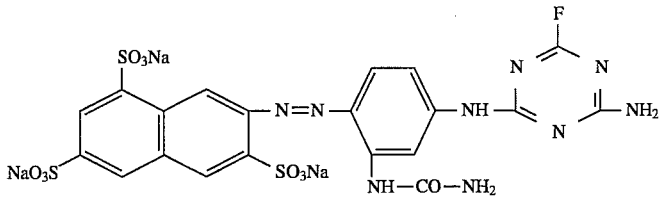

disclosed, for example, in German Offenlegungsschrift No. 2,840,380, followed by heating to 60° C. Dyeing is carried out at 60° C. for 30 minutes by alternating pumping of the liquor through the package. The yarn is then finished on the package in the same manner by rinsing with cold and hot water to which a nonionic detergent may have been added and by rinsing once again with cold water. This produces a level yellow dyeing of the fiber having good fastness properties with respect to the dye.

EXAMPLE 23 a) 10 parts of a polyester/cotton blend fabric are padded with an aqueous solution containing 50 parts of N-(β-sulfatoethyl)piperazine and 30 parts of sodium hydroxide in 1000 parts of water in dissolved form at a liquor pickup of 80%, relative to the weight of the fabric. The impregnated fabric is then thermofixed at 180° C. for 30 seconds, then thoroughly washed with cold and hot water to which a nonionic wetting agent may have been added and once again rinsed with cold water.

b) The modified material is introduced into a HT-dyeing apparatus and treated with an aqueous dye liquor containing, relative to the weight of the dry goods, 0.1 part of the fiber-reactive copper formazan dye disclosed in Example 1 of European Patent No. 0,028,788 and 0.1 part of the disperse dye of the formula

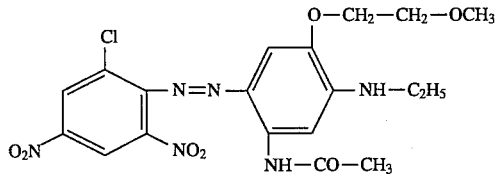

disclosed, for example, in German Auslegeschrift No. 2,833,854 at a liquor ratio of 20:1 first at 60° C. for 30 minutes and then at 130° C. for another 30 minutes. The dyed fabric is then finished in the usual manner, giving a deep blue dyeing on both fiber portions having good wear fastness properties.

EXAMPLE 24

100 parts of a bleached cotton fabric are impregnated in a jigger with 1000 parts of an aqueous solution of 50 parts of N-(β-sulfatoethyl)piperazine and 25 parts of sodium hydroxide at 95° C. for 30 minutes. The liquor is then discharged, and the textile material is then subjected in the same apparatus first to a customary washing process and then to a dyeing process using 1500 parts of an aqueous solution containing 2 parts of an approximately 50% electrolyte-containing dye powder of the fiber-reactive azo dye of the formula

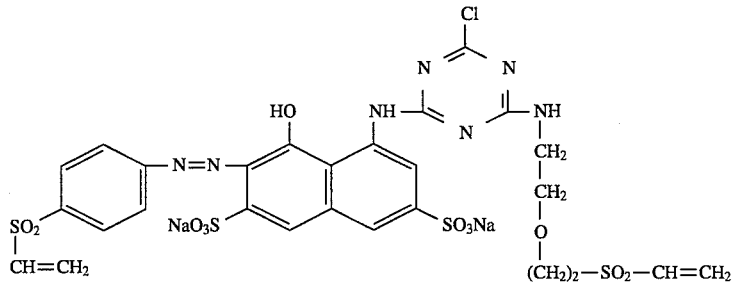

disclosed, for example, in Example 106 of published European Patent Application No. 0,457,715 at 60° C. for 30 minutes. The dyeing obtained is aftertreated and finished in the usual manner. This produces a red dyeing of high color strength and good general fastness properties.

EXAMPLES 25 TO 36

Further dyeings can be produced by starting from a cellulose fiber material modified according to the invention, such as, for example, from a cellulose fiber material modified according to the above Examples and subjecting it according to the invention, i.e., without using alkali and without using an electrolyte or merely using a very small amount of electrolyte, to a dyeing process by one of the customary dyeing methods, such as printing processes, exhaust methods or padding methods, for example analogously to one of the dyeing methods described in the above Examples using one of the dyes listed in the Table Examples which follow and disclosed, for example, in German Auslegeschrift No. 2,835,035, it also being possible for the material used to be a modified cellulose fiber material blended with a polyester fiber material. This produces clear dyeings and prints of high color strength and good fastness properties with respect to the particular dye, here relative to the cellulose fiber material, in the hue given in the particular Table Example.
| Ex. | Dye used (as the alkali metal salt) | Hue |
|---|---|---|
| 25 | 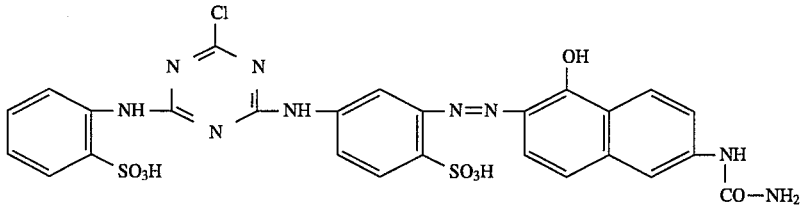 | Orange |
| 26 | 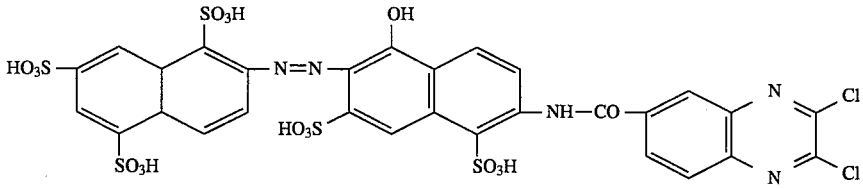 | Orange |
| 27 | 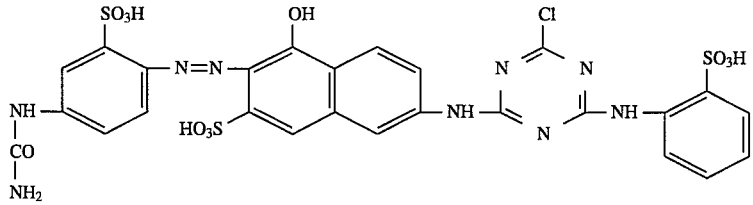 | Scarlet |
| 28 | 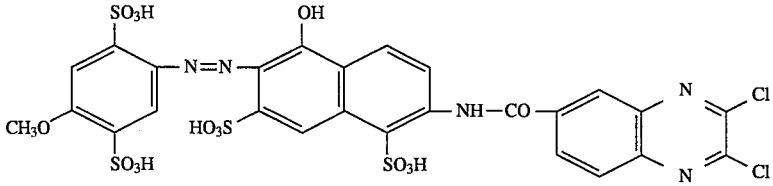 | Scarlet |
| 29 | 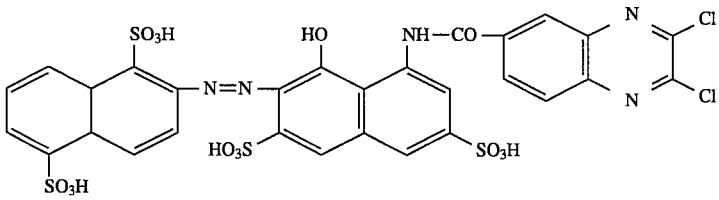 | Red |
| 30 | 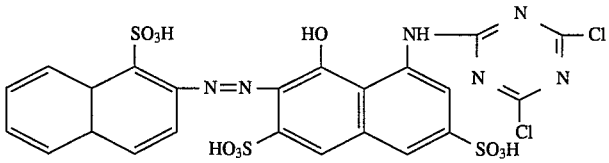 | Red |
| 31 | 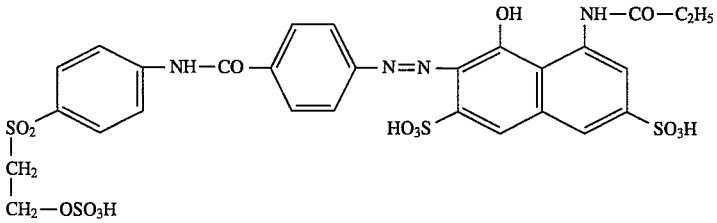 | Red |

-continued

| Ex. | Dye used (as the alkali metal salt) | Hue |
|---|---|---|
| 32 | 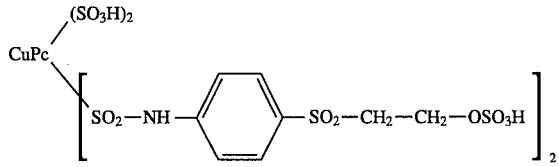 CuPc = Copper phthalocyanine | Turquoise |
| 33 | 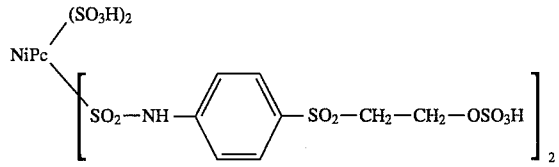 NiPc = Nickel phthalocyanine | Turquoise |
| 34 | 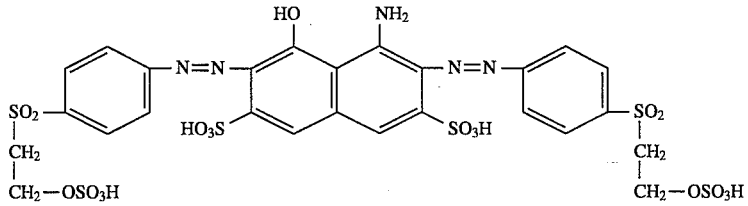 | Navy |
| 35 | 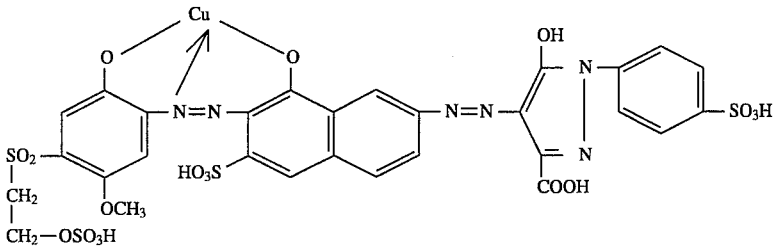 | Anthracite |
| 35 | 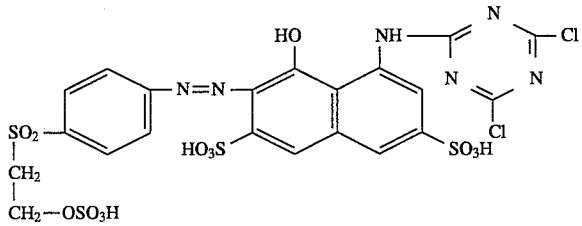 | Red |

What is claimed is:

1. A process for dyeing a fiber material with a water-soluble, anionic dye, which comprises the steps of providing a dye solution which contains from 0 to 10 g/l of electrolyte salts; said dye solution further containing alkali in an amount to give a pH of from 4 to 8, and providing a natural or synthetic fiber material containing hydroxy or carboxamide groups or a combination thereof, which natural or synthetic fiber material has been modified by being brought into contact with an alkaline aqueous solution and a compound which contains a saturated aliphatic radical of 3 to 15 carbon atoms which is unsubstituted or substituted by 1 or 2 or more hydroxy groups and contains at least one primary, secondary or tertiary amino groups or quaternary ammonium group and at least one hydrolyzable ester group, the saturated radical(s) being straight-chain, branched or cyclic or a combination thereof and may be interrupted by one or more hetero groups, with the exception of compounds of the formula (A)

$$(H_2N)_p\text{-ALK-ER} \qquad (A)$$

in which p is the number 1 or 2, ER is an ester group and ALK is an unsubstituted straight-chain or branched alkylene of 2 to 6 carbon atoms which may be interrupted by 1 or more hetero groups, and dyeing said fiber material with said dye solution.

2. The process as claimed in claim 1, wherein the dye contains a fiber-reactive group.

3. The process as claimed in claim 1, wherein the compound by means of which the fiber was modified is a compound of the formula (1a) or (1b)

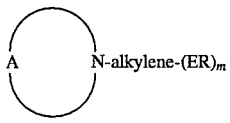

(1a)

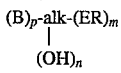

(1b)

in which

ER is an ester group;

A and N, together with 1 or 2 alkylene groups of 1 to 4 carbon atoms, form the bivalent radical of a heterocyclic ring, in which A is an oxygen atom or a group of the formula (a), (b) or (c)

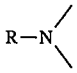

(a)

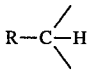

(b)

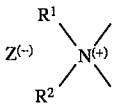

(c)

in which

R is a hydrogen atom or an amino group or an alkyl group of 1 to 6 carbon atoms, which is optionally substituted by 1 or 2 substituents selected from the group consisting of amino, sulfo, hydroxy, sulfato, phosphato and carboxy, or is an alkyl group of 3 to 8 carbon atoms which is interrupted by 1 or 2 hetero groups selected from the group consisting of —O— and —NH— and is optionally substituted by an amino, sulfo, hydroxy, sulfato or carboxy group, $R^1$ is hydrogen, methyl, or ethyl, $R^2$ is hydrogen, methyl, or ethyl, and $Z^{(-)}$ is an anion;

B is an amino group of the formula $H_2N$— or an amino or ammonium group of the formula (d) or (e)

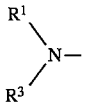

(d)

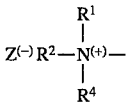

(e)

in which $R^1$, $R^2$ and $Z^{(-)}$ have one of the abovementioned meanings, $R^2$ is methyl or ethyl, and $R^4$ is hydrogen, methyl, or ethyl;

p is the number 1 or 2;

alkylene is a straight chain or branched alkylene of 2 to 6 carbon atoms, which can be substituted by 1 or 2 hydroxy groups, or is a straight-chain or branched alkylene of 3 to 8 carbon atoms which is interrupted by 1 or 2 hetero groups selected from the group consisting of —O— and —NH—;

alk is a straight chain or branched alkylene of 2 to 6 carbon atoms, or is a straight-chain or branched alkylene of 3 to 8 carbon atoms which is interrupted by one or 2 hetero groups selected from the group consisting of —O— and —NH—;

m is the number 1 or 2;

n is a number from 1 to 4;

and the amino, hydroxy and ester groups can be bound to a primary, secondary or tertiary carbon atom on the alkylene group.

4. The process as claimed in claim 1, wherein the ester group of the compound by means of which the fiber was modified is a sulfato or phosphato group or a lower alkanoyloxy group, a phenylsulfonyloxy group, or a phenylsulfonyloxy group substituted on the benzene ring by substituents selected from the group consisting of carboxy, lower alkyl, lower alkoxy, and nitro.

5. The process as claimed in claim 1, wherein the modified fiber material is a modified polyester/cellulose fiber blend material and dyeing is carried out by a single-bath dyeing process using at least one reactive dye and further comprising at least one disperse dye.

6. A process according to claim 1, wherein the saturated aliphatic compound by means of which the fiber material is modified is a compound selected from the group consisting of N-(β-sulfatoethyl) piperazine, N-[β-(β'-sulfatoethoxy-)ethyl] piperazine,N-(γ-sulfato-β-hydroxypropyl)piperidine, N-(γ-sulfato-β-hydroxypropyl)pyrrolidine, N-(γ-sulfatoethyl)piperidine, a 3-sulfato 2-hydroxypropyltrimethylammonium salt or a 2-sulfato 3-hydroxypropyltrimethylammonium salt, 2-sulfato-3-hydroxy-1-aminopropane, 3-sulfato-2-hydroxy-1-aminopropane, 1-sulfato-3 -hydroxy-2-aminopropane, 3-hydroxyl-1-sulfato-2-aminopropane, 2,3-disulfato-1-aminopropane or 1,3-disulfato-2-aminopropane, and derivatives of these compounds with an ester group other than the sulfato group.

7. A process according to claim 1, wherein the saturated aliphatic compound by means of which the fiber material is modified is a compound selected from the group consisting of N-(β-sulfatoethyl)piperidine, N-(γ-sulfato-β-hydroxypropyl)piperidine, N-(γ-sulfato-β-hydroxypropyl)pyrrolidine, 3-sulfato-2-hydroxy-1-aminopropane, 2-sulfato-3-hydroxy-1-aminopropane, a 3-sulfato-2-hydroxypropyltrimethylammonium salt, a 2-sulfato-3-hydroxypropyltrimethylammonium salt, and derivatives of these compounds with an ester group other than the sulfato group.

8. A process as claimed in claim 1, wherein the dye solution is electrolyte free.

9. A process as claimed in claim 1, wherein the dye solution is alkali free.

10. A process as claimed in claim 1, wherein the dye solution is alkali and electrolyte free.

* * * * *